United States Patent [19]

Harding

[11] 4,231,148

[45] Nov. 4, 1980

[54] ELEVATOR ERECTION METHOD

[75] Inventor: Allen W. Harding, Seabrook, Tex.

[73] Assignee: ABC Elevators, Inc., Seabrook, Tex.

[21] Appl. No.: 884,982

[22] Filed: Mar. 9, 1978

[51] Int. Cl.[3] ..... E04B 1/00

[52] U.S. Cl. ..... 29/469; 52/745; 52/30

[58] Field of Search ..... 29/469; 52/30, 745, 52/79.12, 236.3; 187/2

[56] References Cited

U.S. PATENT DOCUMENTS

| | | | |
|---|---|---|---|
| 3,462,908 | 8/1969 | Wysocki | 52/745 |
| 3,741,351 | 6/1973 | Suozzo | 52/30 |
| 3,991,528 | 11/1976 | Dillon | 52/30 |

*Primary Examiner*—Milton S. Mehr

*Attorney, Agent, or Firm*—Browning, Bushman & Zamecki

[57] ABSTRACT

The present invention comprises a method of erecting an elevator system for a building comprising fabricating an elongate elevator shaft framework section, and mounting the framework section in an upright position at the building site. After construction of at least a part of the building, an upper portion of the framework section is secured to the building. An elevator car and elevator accoutrements may be installed in or on the framework section prior to mounting thereof and/or prior to construction of the building and securing of the upper part of the framework section thereto.

17 Claims, 2 Drawing Figures

ELEVATOR ERECTION METHOD

BACKGROUND OF THE INVENTION

1. Field of the Invention

The present invention pertains to the erection of elevator systems for multi-story buildings. Such systems include guide rails which are mounted within the elevator shaft for guiding the travel of the elevator car, various accoutrements which are mounted about the elevator shaft (such as doorframes, headers, call buttons, indicator lights, and the associated wiring), the elevator car assembly with its respective accoutrements, the drive system for raising and lowering the car.

2. Description of the Prior Art

In conventional installation techniques, the aforementioned parts of the elevator system are not installed until the building itself, or at least the structural portion thereof, is substantially complete. This approach is time consuming, complicated and expensive for a number of reasons. Because of the necessity for working within an already constructed building, and due to the fact that the elevator shaft and guide rails are formed as integral parts of the building structure, the elevator system is necessarily delivered to the construction site in relatively small component parts which are assembled at the construction site, mostly within the building. Working within the building further requires a number of specialized techniques for manuevering, assembling, and properly aligning the various parts of the system within the confines of the building structure. As a result, the installation of an elevator system, even in a building of relatively modest height, may typically require one to three months, and must be performed by a relatively large crew of specialized artisans. This not only prolongs the construction process, but also adds substantially to its cost.

One of the factors contributing to the duration and cost of elevator installation operations is the duplication of work. For example, various sub-assemblies of the overall system, such as the elevator car, are typically fully assembled at their respective manufacturing plants for inspection, adjustments, testing and the like. These sub-assemblies must then be disassembled and shipped to the construction site, only to be re-assembled within the substantially completed building as noted above. A partial solution to this problem has been presented by certain partial prefabrication techniques used in various European countries. These techniques have permitted at least the elevator car to be shipped to the construction site and installed in the building in a substantially assembled condition. However, these techniques do not provide a complete and adequate solution to the problems outlined above.

SUMMARY OF THE INVENTION

The present invention provides a method of erecting an elevator system which permits a maximum amount of prefabrication and pre-assembly of the total system. Basic to the method is the fabrication of an elongate elevator shaft framework section. This framework section or tower is transported to the construction site in assembled condition and is mounted in an upright position at the building site. Such mounting preferably takes place before any substantial amount of construction of the building per se, and in any event, before the building is sufficiently completed to prevent lowering of the entire framework section, as a unit, into the proper position. An upper part of the framework section is ultimately secured to the building, which may be constructed around the framework section after mounting thereof.

The present method permits numerous parts of the overall elevator system to be assembled on the framework section prior to transportation to the construction site. This drastically reduces the amount of time required at the construction site for installation of the various parts since the framework section, together with all the other parts mounted thereon or therein, is lowered into place as a unit. Furthermore, even when the time spent at the fabrication plant for mounting these parts on the framework is taken into consideration, the total time required to fabricate and install a complete elevator system by the present method is still much less than that involved with conventional techniques. This is largely due to the fact that the various parts can be mounted on the framework section as a system base independent of the building structure per se. The parts can be mounted on the framework section at the plant much more quickly and conveniently than they could be mounted in a traditional elevator shaft on the construction site since the fabrication plant would include full shop facilities and also because there is no need to work within and around the structural parts of a building. In some embodiments of the invention, various parts may be mounted on the framework section after it has been mounted at the construction site. Nevertheless, there is still a great saving in time and convenience since the building construction, if it has been begun, will be at a relatively early stage, and the crew will not have to work on and within the confines of an essentially completed building structure.

For example, the guide rails for the elevator car are preferably mounted on the framework section at the fabrication plant. There, they can be properly aligned much more easily and with a greater degree of accuracy than would be possible at the construction site. However, even if these rails are mounted on the framework section after it has been in turn mounted at the construction site, it is still substantially easier for the crew to attach and align these rails on the framework free-standing in an open space, then it would be to mount the rails within an enclosed elevator shaft formed by the building structure. Examples of other accoutrements which may be mounted on the framework section at the fabrication plant are: doorframes, headers, doors, switches, wiring, buttons, locks, indicators, etc.

The elevator car itself may also be installed within the framework section prior to mounting of the framework section at the construction site. Alternatively, the framework section may be mounted and the car subsequently lowered into the framework section from the upper end thereof. As still a third alternative, a lateral opening may be provided in the mounted framework section, as by removing one of the guide rail members, and the car may be inserted into the framework section through such opening. The guide rail member is subsequently re-emplaced. In any event, the elevator car is installed in the framework section in a fully assembled condition, rather than being assembled from component parts within a substantially completed building.

The framework section is preferably mounted at the construction site by emplacing its lower end into a pit provided for the purpose, e.g. in the building foundation. However, the use of such a pit is optional, i.e. the end of the framework section could be placed on the foundation with no pit. At least a portion of the building may then be constructed around the mounted framework section and attached thereto at suitable locations above the aforementioned pit. If the building is to be relatively tall, a second framework section may then be mounted on top of the first framework section. A further portion of the building structure is then constructed up around the second framework section and secured thereto, and so forth until the building has attained the desired height.

The framework of the elevator shaft, whether it be made up of one or more sections, need not - and preferably does not - form any part of the load bearing structure for the building per se, the attachment of the framework to the building being rather for the purpose of integrating the total structure and stabilizing the framework. Indeed an important feature of the invention is that the weight of the elevator car and its drive means need not be borne by the framework. Rather, in the case of a traction type elevator, a support platform or floor is constructed above the elevator framework so that it is supported by the load bearing structure of the surrounding building. The elevator drive means is mounted on the support platform and the elevator car is suspended from the drive means so that the weight of the drive means and car is supported by the building. In the case of a hydraulic elevator, the weight of the car is, of course, borne by the hydraulic structure located beneath the car and supported ultimately by the building formation. Thus the framework serves primarily as a means for tying together various parts of the elevator system and basically need be only sturdy enough to support its own weight and that of the rails and other accoutrements mounted thereon. However, as noted above, the elevator car may be installed in the framework prior to transportation to the construction site. In such instances, the framework may be made capable of supporting the weight of at least the car during the early stages of the installation process. In other cases, means may be provided at the lower end of the mounted framework for supporting the weight of the car during completion of the process.

Accordingly, it is a principle object of the present invention to provide an improved method of erecting an elevator system for a building.

Another object of the invention is to provide an elevator erection method which permits maximum prefabrication and pre-assembly of the total elevator system.

A further object of the present invention is the provision of an elevator erection method wherein a shaft framework is preformed and mounted at the construction site prior to substantial construction of the building.

Still another object of the present invention is to substantially reduce the time and manpower required for the erection of an elevator system.

Further objects, features and advantages of the present invention will be made apparent by the following description of preferred embodiments, the drawing, and the claims.

DESCRIPTION OF THE PREFERRED EMBODIMENTS

Figure 1:
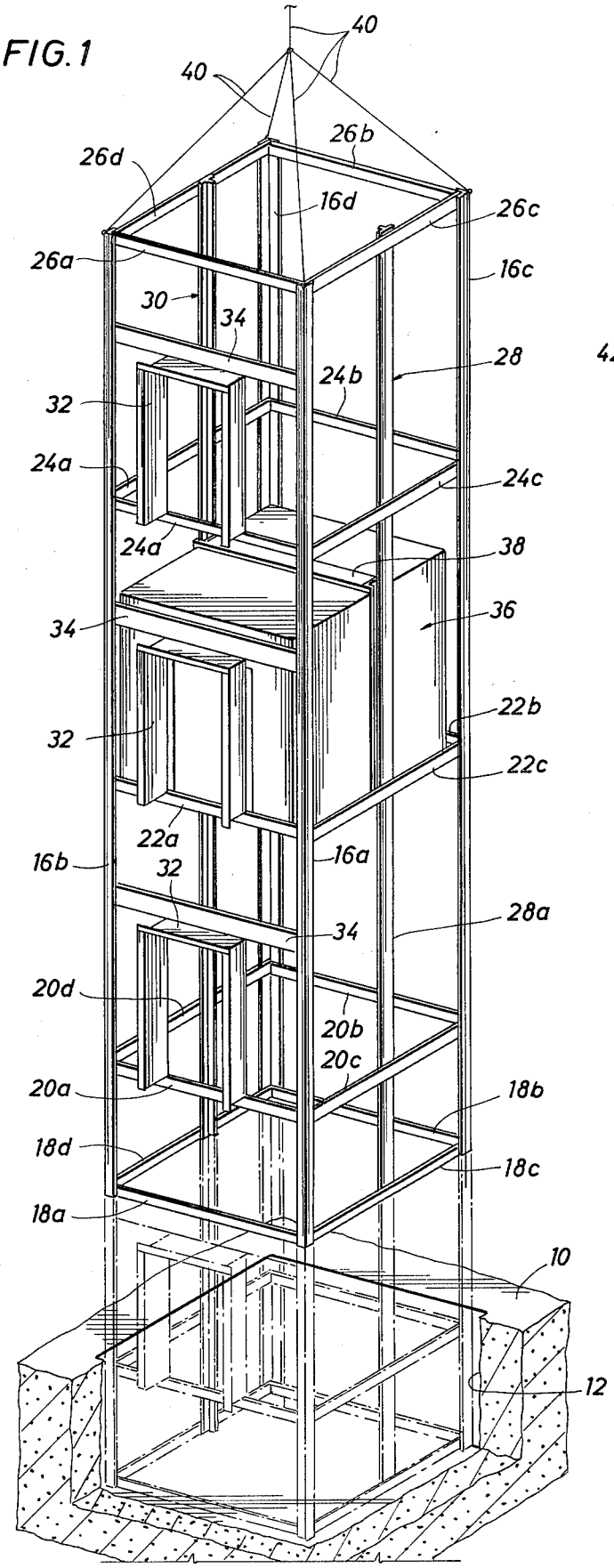
FIG. 1 is a perspective view of a framework section being mounted at the construction site.

Referring now to the drawing, there is illustrated an exemplary elevator system installation in accord with the present invention. As a preliminary step in such installations, the foundation 10 for the building in which the elevator system is to be disposed is poured. A recess or pit 12 is formed in foundation 10 and is sized to receive and fairly closely surround the lower end of an elevator shaft framework section 14. Fabrication of framework section 14 and assembly therewith of various other parts of the system is preferably done at an appropriate shop or plant remote from the building construction site.

Framework section 14 is generally rectangular and includes four parallel corner members or legs 16*a*, 16*b*, 16*c* and 16*d* extending lengthwise of the framework section 14. Corner members 16*a*, 16*b*, 16*c* and 16*d* are interconnected by a plurality of sets of lateral members or girts spaced longitudinally along corner members 16*a*, 16*b*, 16*c* and 16*d*. The first or lower-most such set of lateral members is disposed at the ends of corner members 16*a*–16*d* intended to form the lower end of the framework section 14 and includes a front member 18*a* interconnecting corner members 16*a* and 16*b*, a rear member 18*b* interconnecting corner members 16*c* and 16*d*, a right side member 18*c* interconnecting corner members 16*a* and 16*c*, and finally a left side member 18*d* interconnecting corner members 16*b* and 16*d*. The second set of lateral members is spaced longitudinally from members 18*a*–18*d* by a distance generally corresponding to the distance from the bottom of pit 12 to the planned location of the first floor of the building to be constructed. This second set includes front member 20*a*, rear member 20*b*, right side member 20*c* and left side member 20*d*. Additional sets of lateral members 22*a*–22*d*, 24*a*–24*d*, and 26*a*–26*d* are also provided, each set being spaced longitudinally from the last preceeding set by a distance generally corresponding to the intended distance between floors of the building to be constructed. The corner members and the various lateral members described above may be formed of metal, prestressed concrete, or any other suitable material, and are connected together by bolts, welding or some other suitable method, depending upon the nature of the structural members themselves.

Right and left guide rails 28 and 30 respectively are mounted on framework section 14, preferably prior to transportation of the framework section to the building construction site. Guide rail 28 extends longitudinally along framework section 14 intermediate corner members 16*a* and 16*b*, and is suitably secured to lateral members 18*c*, 20*c*, 22*c*, 24*c* and 26*c* which connect corner members 16*a* and 16*c*. Similarly, guide rail 30 extends longitudinally along the framework section intermediate corner members 16*b* and 16*d*, being connected to the adjacent lateral members. Each of the guide rails 28 and 30 may be made up of a plurality of rail members disposed end to end. Guide rails 28 and 30 are aligned and straightened at the fabrication site, with full shop facilities available for that purpose, and are secured in the properly aligned positions on framework section 14 in any suitable manner.

Various other elevator accoutrements may also be mounted on framework section 14. For the sake of simplicity, these accoutrements have been illustrated in the drawing only as doorframes 32 and headers 34.

However, it should be understood that virtually all the elevator accoutrements commonly mounted about a conventional elevator shaft, including but not limited to buttons, indicator lights, doors, locks, trim and wiring may be mounted on framework section 14 at the fabrication site prior to transportation of framework section 14 to the building construction site. Where necessary or desired, protective coverings may be placed over such elevator accoutrements to prevent damage during transportation and mounting of the framework section, construction of the building, etc.

An elevator car assembly 36, including a surrounding sling 38 may also be mounted within framework section 14 at the fabrication site. The car assembly 36 is fully assembled and includes the elevator doors, lights, buttons, floor and wall coverings, wiring, etc. The elevator car sling 38 is adapted to slidably engage guide rails 28 and 30 in a manner well known in the art to guide elevator car assembly 36 in its longitudinal movement during use. Sling 38 is also adapted to be engaged by the suspending cables, in the case of a traction type elevator, or by the hydraulic lifting means, in the case of a hydraulic elevator, for moving the entire car assembly 36. After inserting into framework section 14, car assembly 36 may be blocked or otherwise temporarily suspended in place at a position intermediate the ends of framework section 14 by suitable means (not shown).

The entire unit consisting of the framework section 14, the guide rails 28 and 30 and other accoutrements mounted thereon, and the elevator car assembly 36 therein, are then transported to the building construction site. At the site, the framework section 14 is mounted in an upright position. For example, cables 40 may be suitably secured to the upper end of framework section 14, and the entire unit may be lowered, as by a crane, (not shown), into pit 12 until the bottom of framework section 14 rests on the bottom of the pit as indicated in phantom in FIG. 1. The lower end of framework section 14 may then be secured to the side walls or bottom of pit 12 by any suitable means to further stabilize the framework section. The suspension of elevator car assembly 36 above the lower end of framework section 14 permits workmen to enter the pit 12 after the framework section 14 has been placed therein to secure the framework section or perform any other necessary tasks.

As mentioned above, the entire elevator car assembly 36 may be installed in framework section 14 prior to mounting of the latter in pit 12. However, other alternatives are possible. For example, the framework section 14, along with any attached elevator accoutrements such as guide rails 28 and 30, may be first mounted in pit 12. Car assembly 36 can then be lowered into framework section 14 from the upper end thereof. As another alternative, one of the lower rail members making up one of the guide rails, for example, member 28*a* of guide rail 28 which is aligned with the first floor portion of framework section 14, may be removed to provide a lateral opening in framework section 14. Because elevator car assembly 36 is shorter than the distance between floors of the building, and thus between members 20*c* and 22*c* of the framework section, and is not as deep as the framework section (to provide room for the counterweights, etc.), the fully assembled car assembly 36 including sling 38 may then be inserted through the aforemetioned lateral opening in framework section 14. The guide rail member 28*a* is then replaced and secured in proper position. The method of installing elevator car assembly 36 is thus versatile and may be adapted to the needs at any particular construction site. However, in any event, car assembly 36 is preferably installed in framework section 14 in a fully assembled condition thereby substantially simplifing and shortening the installation procedure.

As discussed hereinabove, the guide rails 28 and 30 and other elevator accoutrements represented by doorframes 32 and headers 34 may advantageously be mounted on framework section 14 prior to mounting of the framework section itself at the construction site, preferably at the fabrication plant. However, if for any reason it is desired to first mount only the framework section 14 per se, the accoutrements can later be mounted on the free-standing framework section 14 much more easily than they could be mounted about the enclosure formed by a conventional completed elevator shaft and within the confines of a substantially fully constructed building.

Framework section 14 can be most easily lowered into place and mounted in the pit 12 where only the foundation 10 and no part of the building per se, has been constructed. However, the method of the invention can still be practiced on a partially constructed building as long as the building structure leaves a sufficient open area to permit lowering of framework section 14 into place, and in particular, so long as the building structure is open at its upper end adjacent the elevator shaft site. After mounting of framework section 14 in pit 12, the building, or the remaining portion thereof, can be construed around the mounted free-standing framework section.

Figure 2:
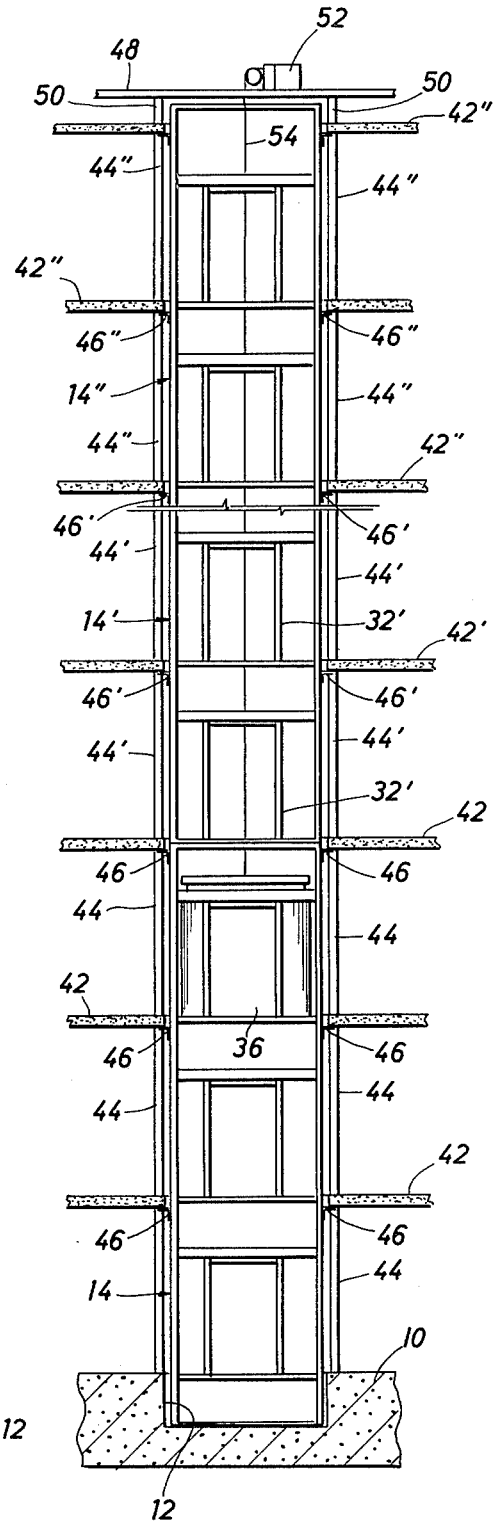
FIG. 2 is an elevational view of the completed elevator system with portions of the attached building structure.

FIG. 2 diagrammatically illustrates such building construction in the form of floor structures 42 interconnected by load bearing support columns 44. After construction of the basic structural portions of the building, upper portions of framework section 14, i.e. portions located substantially above the pit 12, are connected to the surrounding building structure in any suitable manner as diagrammatically indicated by brackets 46. However, it is noted that such connections are made for the purpose of stabilizing the framework section 14 and do not impose upon framework section 14 any substantial portion of the weight of the building structure per se, the latter being borne by columns 44 and similar structural members throughout and forming part of the building.

If the intended height of the completed building is relatively large, for example, over four or five stories, it is generally impractical to attempt to provide a single framework section, such as 14, for the full height of the elevator system. Thus, when the building construction has reached a point near the top of framework section 14, typically three to four stories, a second framework section 14' may be mounted on top of the first framework section 14. Framework section 14' is substantially identical to framework section 14 except that it does not include a lower portion for mounting in a pit. Rather, its lower end is designed for disposition immediate adjacent a floor of the building, and thus has the lower end of one of the doorframes 32' mounted adjacent thereto. Nor does the framework section 14' contain an elevator car assembly, the latter having been previously mounted in lower framework section 14. Otherwise, framework section 14' is substantially identical to framework section 14, and in particular, has mounted thereon similar elevator accoutrements including guide rails, doorframes, headers, etc. Framework section 14' may be secured to framework section 14 in any suitable manner, such as by interconnecting the sections with rigid metal plates or the like and bolting such plates to the sections, welding, or some combination of such techniques.

With the framework section 14' properly mounted, further portions of the building structure may be built up around framework section 14', as indicated by floors 42' and the support columns 44'. This portion of the building structure is then secured to upper portions of framework section 14', i.e. portions above the lower end of the framework section as indicated by brackets 46'.

Additional framework sections are mounted successively on top of one another until the framework has reached the intended height of the elevator shaft, the building structure being gradually built up around and attached to the framework sections as they are mounted. In FIG. 2 the uppermost framework section is shown at 14''. A portion of the building structure including floors 42'' and support columns 44'' are built up around framework section 14'' and attached thereto as indicated by brackets 46''.

Where the elevator system being installed is of the traction type, a support means comprising a platform 48 resting on vertical members 50 is mounted on the building structure so that its weight is borne by the bulding but so that it is positioned directly above the upper end of framework section 14''. The drive means 52 for the elevator car assembly 36 is mounted on platform 48, either before or after mounting of the platform on the building structure, and elevator car assembly 36 is suspended from drive means 52 by the usual cable means diagrammatically indicated at 54. The elevator counterweights (not shown) are also installed in the usual manner. Thus, in use, the weight of the drive means, counterweights, and elevator car assembly is borne by the structure of the building rather than by the framework 14, 14' and 14'' of the elevator system.

If the elevator system is of the hydraulic type, the hydraulic motor and associated apparatus is installed below the elevator system at any appropriate time during the construction operation, either before or after emplacement of the elevator framework, so that the weight of the elevator car assembly 36 and its drive means are, in use, borne by the building foundation and ultimately the earth, rather than by the elevator framework.

Where the building being constructed is relatively short, e.g. five stories or less, a single framework section 14 may be employed. If the elevator system is of the traction type, the support means 48 and 50, drive means 52, counterweights, cables, etc. would be mounted on the building structure above framework section 14 in substantially the same manner as described above.

Erection of an elevator system in accord with the method of the present invention drastically reduces the cost and time required for installation. For example, an elevator system for a four-story building has been completely fabricated and erected in accord with the present method in as few as seven days, only three of these days representing work at the building construction site, the other four days representing fabrication and assembly procedures performed at the plant. By comparison, installation of a comparable type of system using conventional techniques might typically take a month or more - not counting pre-assembly, testing and adjusting, and disassembly of the various sub-systems. The cost is further reduced by the fact that the fully assembled framework section along with the enclosed elevator car assembly and the attached elevator accoutrements, can be installed by a crane operator and a two-man crew, which need not be highly specialized. Even where the car assembly and/or various other parts are mounted after mounting of the framework, the degree of specialization of techniques is still reduced by the elimination of the need to work around a closed shaft in a substantially completed building. Thus, it can be seen that the method of the present invention represents a striking improvement over conventional elevator installation techniques.

It can further be seen that numerous modifications of the exemplary embodiments described above may be made by those skilled in the art without departing from the scope of the invention. For example, the number, size and arrangement of the various members of the framework section can be varied in accord with well known engineering practice. Likewise, the number and nature of the elevator accoutrements mounted on the framework will vary depending upon the particular elevator system in question. The means of mounting the framework section at the building construction site can also be varied. Accordingly, it is intended that the scope of the invention be limited only by the claims which follow.

I claim:

1. A method of erecting an elevator system for a building comprising the steps of:

fabricating an elongate elevator shaft framework section;

mounting said framework section in an upright position at the site of said building constructing at least a part of said building around said mounted framework section;

and subsequently securing an upper part of said framework section to said building.

2. The method of claim 1 further comprising mounting elevator car guide rails along opposite sides of said framework section.

3. The method of claim 1 further comprising mounting elevator accoutrements on said framework section.

4. The method of claim 3 wherein said accoutrements are mounted prior to securing said upper part of said framework section to said building.

5. The method of claim 3 wherein said accoutrements are mounted prior to mounting of said framework section at said building site.

6. The method of claim 1 further comprising forming a pit at said building site, and wherein said mounting of said framework section at said building site includes mounting the lower end of said framework section in said pit.

7. The method of claim 6 wherein said pit is formed at least partially in the foundation for said building.

8. The method of claim 1 wherein said framework section is mounted at said building site prior to substantial construction of said building.

9. The method of claim 1 further comprising fabricating another such elongate elevator shaft framework section;

mounting said other framework section above the first mounted framework section;

constructing a further portion of said building around said other framework section;

and securing an upper part of said other framework section to said building.

10. The method of claim 1 further comprising constructing support means above said framework section for supporting a load thereon independently of said framework section;

mounting elevator drive means on said support means;

and suspending an elevator car assembly from said elevator drive means.

11. A method of erecting an elevator system for a building comprising the steps of:

fabricating an elongate elevator shaft framework section;

mounting elevator car guide rails along opposite sides of said framework section;

subsequently mounting said framework section in an upright position at the site of said building;

and securing an upper part of said framework section to said building.

12. The method of claim 11 further comprising aligning said guide rails prior to mounting of said framework section at said building site.

13. The method of claim 11 further comprising installing an elevator car assembly within said framework section in sliding contact with said guide rails.

14. The method of claim 13 wherein said car assembly is installed in said framework section prior to mounting of said framework section at said building site.

15. The method of claim 13 wherein said car assembly is lowered into said framework section after mounting of said framework at said building site.

16. A method of erecting an elevator system for a building comprising the steps of:

fabricating an elongate elevator shaft framework section;

providing a lateral opening in said framework section;

inserting an elevator car assembly through said lateral opening into said framework section;

emplacing a rail member over said lateral opening to form a part of a set of guide rails for sliding contact with said car assembly;

mounting said framework section in an upright position at the site of said building;

and securing an upper part of said framework section to said building.

17. The method of claim 16 wherein said car assembly is inserted and said rail member is emplaced after mounting of said framework section at said building site.

* * * * *